US005214404A

United States Patent [19]

Yamaguchi et al.

[11] Patent Number: 5,214,404

[45] Date of Patent: May 25, 1993

[54] CONTINUOUSLY MAGNETIZING MAGNET

[75] Inventors: Takayoshi Yamaguchi; Isamu Kobayashi, both of Tokyo, Japan

[73] Assignee: Japan Life Co., Ltd., Tokyo, Japan

[21] Appl. No.: 738,378

[22] Filed: Jul. 31, 1991

[30] Foreign Application Priority Data

Jul. 30, 1990 [JP] Japan ..... 2-80890

[51] Int. Cl.[5] ..... H01F 7/00

[52] U.S. Cl. ..... 335/302; 335/303; 335/306

[58] Field of Search ..... 335/210-214, 335/296-306; 600/9-15

[56] References Cited

U.S. PATENT DOCUMENTS 4,197,618 4/1980 Bourguignon ..... 24/201 B
4,391,270 7/1983 Uragami ..... 600/15
4,480,155 10/1984 Winey ..... 381/201
4,798,194 1/1989 Amishima ..... 128/9

FOREIGN PATENT DOCUMENTS 0041518 3/1977 Japan ..... 381/201
0192738 10/1985 Japan ..... 600/15

*Primary Examiner*—Leo P. Picard
*Assistant Examiner*—Ramon M. Barrera
*Attorney, Agent, or Firm*—Browdy and Neimark

[57] ABSTRACT

A continuously magnetizing magnet for use in bedding for magnetic medical treatment is made of magnetic material whose semicircular crests and semicircular bases are alternately combined in series and the crests are magnetized so that they have alternately N and S magnetic poles.

As the magnetic poles are isolated via the base, the magnetic lines of force are vertically generated and the magnetic density at a position upwardly far from both magnetic poles increases.

2 Claims, 1 Drawing Sheet

CONTINUOUSLY MAGNETIZING MAGNET

BACKGROUND OF THE INVENTION

1. Field of the Invention

The present invention relates to a continuously magnetizing magnet which has continuous crests and is for use in bedding for magnetic medical treatment.

2. Description of the Prior Art

There are known threadlike continuously magnetizing magnets, laminar ones and the like for use in bedding for magnetic medical treatment (Japanese Patent Laid-Open No. 224303/1990), N and S magnetic poles being alternately arranged therein.

As these conventional threadlike or laminar continuously magnetizing magnets are planar, one magnetic pole and another are adjacent to each other and the distance between them is therefore short. For this reason, magnetic flux concentrates near the surface of magnetic material forming a permanent magnet and magnetic lines of force draw a high-density loop near the surface of the magnet without jumping up. Consequently, with the magnet embedded in a mattress for magnetic medical treatment, for instance, the effect of magnetic medical treatment is hardly achievable as the magnetism has almost no effect on a depth of the human body.

SUMMARY OF THE INVENTION

An object of the present invention is therefore to provide a continuously magnetizing magnet simple in construction and still capable of increasing magnetic density at a position far from the magnet and thereby demonstrating the power thereof in magnetic medical treatment and the like.

Another object of the present invention is to provide a continuously magnetizing magnet capable of achieving the effect of a finger-pressure therapy and that of magnetic medical treatment, when the magnet is used in a mattress for magnetic medical treatment.

A continuously magnetizing magnet according to the present invention is made of magnetic material whose semicircular crests and semicircular bases are alternately combined in series and the crests are magnetized so that they have alternately N and S magnetic poles.

In the case of this magnet, magnetic poles are isolated via a base and magnetic lines of force are vertically generated. Moreover, the magnetic flux density at a position far from both the magnetic poles is increased.

Other and further objects, features and advantages of the present invention will appear more fully from the following description.

DESCRIPTION OF THE PREFERRED EMBODIMENT

The preferred embodiment of the present invention will subsequently be described with reference to the accompanying drawings.

Figure 1:
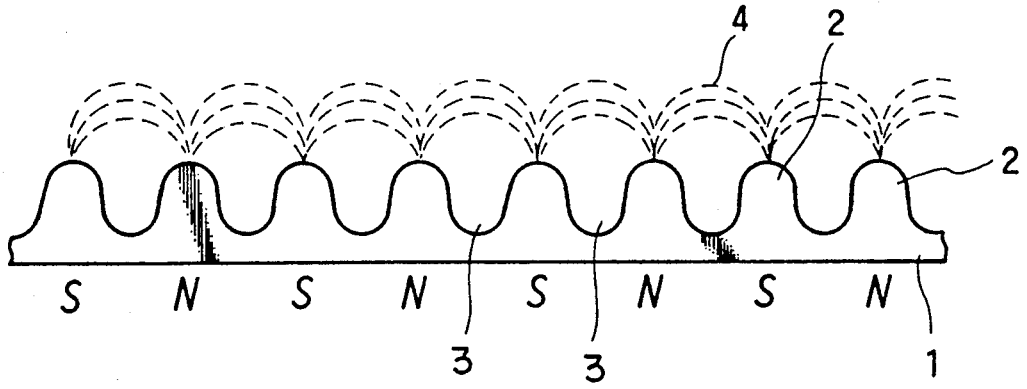
FIG. 1 is an elevational view of an embodiment of the present invention.
Figure 2:
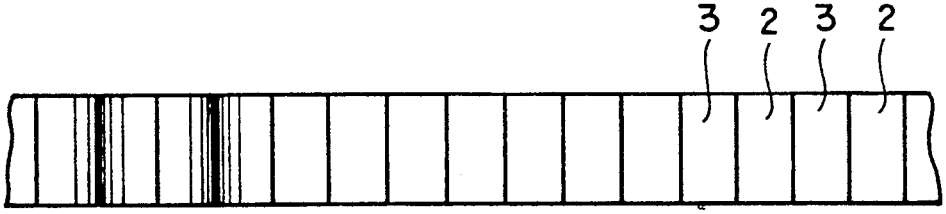
FIG. 2 is a plan view thereof.

In FIG. 1, a ferrite magnet or a bonded magnet prepared from a mixture of rare earth magnet powder and plastics or rubber is used to form a magnetic material 1. Semicircular crests 2 and semicircular bases 3 are alternately combined in series and the crests 2 are magnetized so that they have alternately N and S magnetic poles.

In the case of this magnet, though magnetic lines of force are generated from the crest 2 formed from the N magnetic pole to the adjacent crest 2 formed from the S magnetic pole, the magnetic path length is increased and the magnetic lines of force are vertically generated as the crests 2 are isolated via the base 3. In other words, the magnetic density at a position upwardly far from both magnetic poles increases. Provided any patient lies on a mattress for magnetic medical treatment with the magnet as a magnetism generating source, the magnetic lines of force 4 can reach a depth of the human body to ensure a satisfactory magnetic medical treatment effect. Simultaneously, the crests 2 makes achievable a finger-pressure therapeutical effect.

When the magnet according to the present invention is employed as what is used in a mattress for magnetic medical treatment, it is cut into convenient lengths and these pieces are joined securely with an adhesive or the like to the surface of the mattress body with the crests 2 upward. In this case, grooves for embedding the pieces of magnet may be provided in the surface of the mattress. These pieces of magnet are normally arranged in a multiple row in the longitudinal direction of the mattress.

We claim:

1. A continuously magnetizing magnet comprising a body of magnetic material having a flat bottom side and a top side spaced therefrom, said top side having a plurality of semicircular crests and semicircular bases joined in series along the longitudinal axis of said body, and both said crests and said bases being spaced from the flat side, said crests being magnetized so that they are alternately N and S magnetic poles on said top side of said magnetic material body.

2. A continuously magnetizing magnet as claimed in claim 1, wherein said body of magnetic material is a ferrite magnet prepared from material selected from a group consisting of plastics and rubber containing rare earth magnetic powder kneaded therein.

* * * * *